US009970723B1

(12) United States Patent
Findlay et al.

(10) Patent No.: US 9,970,723 B1
(45) Date of Patent: May 15, 2018

(54) SEAR BLOCK TRIGGER SAFETY

(71) Applicant: Smith & Wesson Corp., Springfield, MA (US)

(72) Inventors: David S. Findlay, Athol, MA (US); Sean O'Clair, Feeding Hills, MA (US)

(73) Assignee: Smith & Wesson Corp., Springfield, MA (US)

( * ) Notice: Subject to any disclaimer, the term of this patent is extended or adjusted under 35 U.S.C. 154(b) by 0 days. days.

(21) Appl. No.: 15/465,957

(22) Filed: Mar. 22, 2017

(51) Int. Cl.

| | |
|---|---|
| ***F41A 19/00*** | (2006.01) |
| ***F41A 17/46*** | (2006.01) |
| ***F41A 19/10*** | (2006.01) |
| ***F41A 19/12*** | (2006.01) |

(52) U.S. Cl.
CPC ..... *F41A 17/46* (2013.01); *F41A 19/10* (2013.01); *F41A 19/12* (2013.01)

(58) Field of Classification Search
CPC ..... F41A 17/46; F41A 17/56; F41A 19/10; F41A 19/12
See application file for complete search history.

(56) References Cited

U.S. PATENT DOCUMENTS

| | | | | |
|---|---|---|---|---|
| 290,737 | A | 12/1883 | Brown | |
| 6,553,706 | B1 * | 4/2003 | Gancarz | F41A 17/46 42/69.02 |
| 8,220,193 | B1 * | 7/2012 | Lynch | F41A 17/48 42/70.08 |
| 8,250,799 | B2 | 8/2012 | Duperry et al. | |
| 9,046,313 | B1 | 6/2015 | Lutton et al. | |
| 9,383,153 | B2 * | 7/2016 | Nebeker | F41A 17/72 |
| 9,441,897 | B2 | 9/2016 | Mather et al. | |
| 9,658,007 | B2 * | 5/2017 | Withey | F41A 3/22 |
| 9,810,469 | B2 * | 11/2017 | Boehde | F04D 27/004 |
| 2003/0213159 | A1 * | 11/2003 | Cutini | F41A 17/46 42/70.06 |
| 2010/0024273 | A1 * | 2/2010 | Duperry | F41A 19/10 42/69.01 |
| 2015/0330727 | A1 | 11/2015 | Kolev et al. | |
| 2015/0330731 | A1 | 11/2015 | Kolev et al. | |
| 2015/0330734 | A1 | 11/2015 | Kolev et al. | |
| 2016/0187092 | A1 * | 6/2016 | Mather | F41A 19/10 42/69.02 |

* cited by examiner

*Primary Examiner* — Gabriel Klein
(74) *Attorney, Agent, or Firm* — John A. Chionchio, Esquire; Ballard Spahr LLP

(57) ABSTRACT

A trigger mechanism for a firearm includes a sear which interacts with a trigger. The sear and trigger are held in contact by a sear block. The sear block has dogs which engage respective locking surfaces on the sear and trigger. Pivoting motion of the sear block disengages the dogs from the trigger and sear and allows the trigger to pivot and release the sear to discharge the firearm. When the dogs are engaged with the sear and trigger the resistance to inadvertent discharge due to inertial loads imposed on the mechanism when the firearm is dropped is increased.

24 Claims, 4 Drawing Sheets

SEAR BLOCK TRIGGER SAFETY

FIELD OF THE INVENTION

This invention concerns trigger mechanisms and associated safeties.

BACKGROUND

Safety mechanisms for firearms provide an effective means for rendering a firearm incapable of discharging a round when force is applied directly to the firearm's trigger, for example, by the shooter. However, situations arise when a round may be inadvertently discharged even when the safety mechanism is engaged. For example, when a firearm such as a rifle or pistol is dropped, the trigger mechanism is subjected to inertial forces occasioned by rapid deceleration on impact. The sudden jolt may overcome the safety mechanism and cause the firearm to discharge if a round is chambered. There is clearly an opportunity to improve the dependability of firearm safety mechanisms by augmenting their resistance to inadvertent discharge when subject to inertial forces.

SUMMARY

The invention concerns a trigger mechanism for a firearm. In one example embodiment the trigger mechanism comprises a sear mounted on the firearm for pivoting motion about a sear pivot point. The sear has an action surface and a sear locking surface thereon. A trigger is pivotably mounted on the firearm. The trigger has a contact surface movable into and out of engagement with the action surface of the sear upon pivoting motion of the trigger. A sear block is mounted on the trigger for pivoting motion about a sear block pivot point. The sear block comprises a finger engaging portion positioned on a first side of the sear block pivot point and a sear dog positioned on a second side of the sear block pivot point. The sear dog is movable into and out of engagement with the sear locking surface upon pivoting motion of the sear block. Engagement between the sear dog and the sear locking surface prevents pivoting motion of the trigger.

Another example embodiment further comprises a trigger locking surface mounted on the trigger. A trigger dog is mounted on the sear block. The trigger dog is movable into and out of engagement with the trigger locking surface upon pivoting motion of the sear block. Further by way of example, the sear pivot point and the sear block pivot point are aligned co-linearly with a point of contact between the sear dog and the sear locking surface. In another example embodiment the sear pivot point and the sear block pivot point are aligned co-linearly with a point of contact between the sear dog and the sear locking surface and a point of contact between the trigger locking surface and the trigger dog.

In a specific example embodiment the sear locking surface is positioned on a projection extending from the sear. By way of example, the projection comprises a pin oriented parallel to a pivot axis of the sear. In a further example the trigger locking surface is positioned on a projection extending from the trigger. In a particular example embodiment the projection comprises a pin oriented parallel to a pivot axis of the trigger.

In an example embodiment the sear dog comprises a notch positioned in the sear block. The notch has an edge surface engageable with the sear locking surface. By way of example, the edge surface is oriented at an angle with respect to a line extending through the sear block pivot point and the sear pivot point when the edge surface engages the sear locking surface. Further by way of example, the trigger dog comprises a notch positioned in the sear block. The notch has an edge surface engageable with the trigger locking surface. By way of example the edge surface is oriented at an angle with respect to a line extending through the sear block pivot point and the sear pivot point when the edge surface engages the trigger locking surface. In a further example embodiment the sear block is balanced about the sear block pivot point.

The invention also encompasses an example trigger mechanism for a firearm comprising a sear mounted on the firearm for pivoting motion about a sear pivot point. The sear has an action surface and a sear locking surface thereon. A trigger is pivotably mounted on the firearm. The trigger has a trigger locking surface and a contact surface thereon. The contact surface is movable into and out of engagement with the action surface of the sear upon pivoting motion of the trigger. A sear block is mounted on the trigger for pivoting motion about a sear block pivot point. The sear block comprises a finger engaging portion positioned on a first side of the sear block pivot point. A sear dog is positioned on a second side of the sear block pivot point. The sear dog is movable into and out of engagement with the sear locking surface upon pivoting motion of the sear block. A trigger dog is mounted on the sear block. The trigger dog is movable into and out of engagement with the trigger locking surface upon pivoting motion of the sear block. Engagement between the sear dog and the sear locking surface prevents pivoting motion of the trigger.

In an example embodiment the trigger dog is positioned between the sear dog and the sear block pivot point. By way of example the sear pivot point and the sear block pivot point are aligned co-linearly with a point of contact between the sear dog and the sear locking surface. Further by way of example the sear pivot point and the sear block pivot point are aligned co-linearly with a point of contact between the sear dog and the sear locking surface and a point of contact between the trigger locking surface and the trigger dog.

In a specific example the sear locking surface is positioned on a projection extending from the sear. By way of example the projection comprises a pin oriented parallel to a pivot axis of the sear. In a further example the trigger locking surface is positioned on a projection extending from the trigger. In an example embodiment the projection comprises a pin oriented parallel to a pivot axis of the trigger.

In an example embodiment the sear dog comprises a notch positioned in the sear block. The notch has an edge surface engageable with the sear locking surface. In an example embodiment the edge surface is oriented angularly with respect to a line extending through the sear block pivot point and the sear pivot point when the edge surface engages the sear locking surface. Further by way of example, the trigger dog comprises a notch positioned in the sear block. The notch has an edge surface engageable with the trigger locking surface. In an example embodiment the edge surface is oriented at an angle with respect to a line extending through the sear block pivot point and the sear pivot point when the edge surface engages the trigger locking surface. In another example embodiment the sear block is balanced about the sear block pivot point.

DETAILED DESCRIPTION

Figure 1:
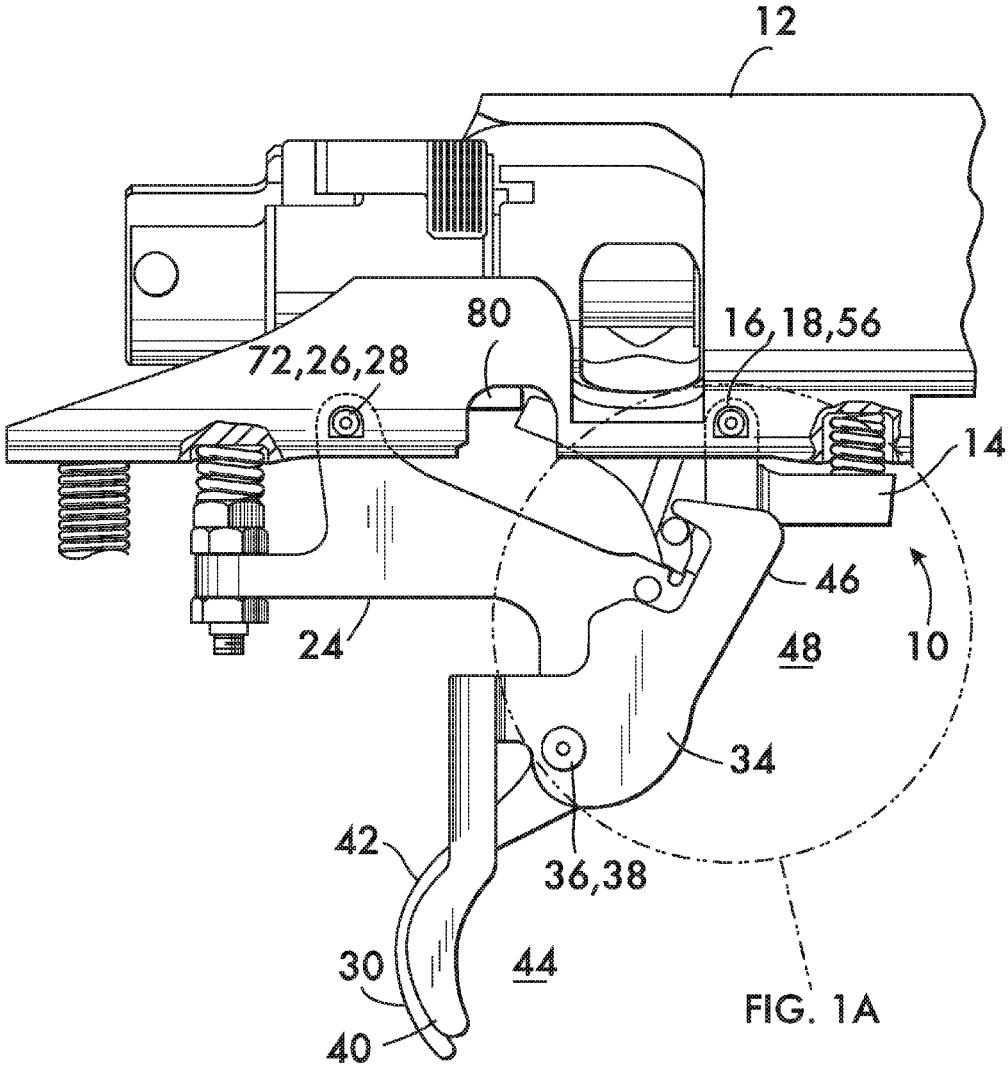
FIGS. 1-3 are side views of an example embodiment of a trigger mechanism according to the invention and a firearm receiver.

FIG. 1 shows an example embodiment of a trigger mechanism 10 according to the invention. Mechanism 10 is illustrated mounted on a bolt action rifle receiver 12, but it is understood that this is by way of example only, the invention being useful on any type of firearm.

Figure 1A:
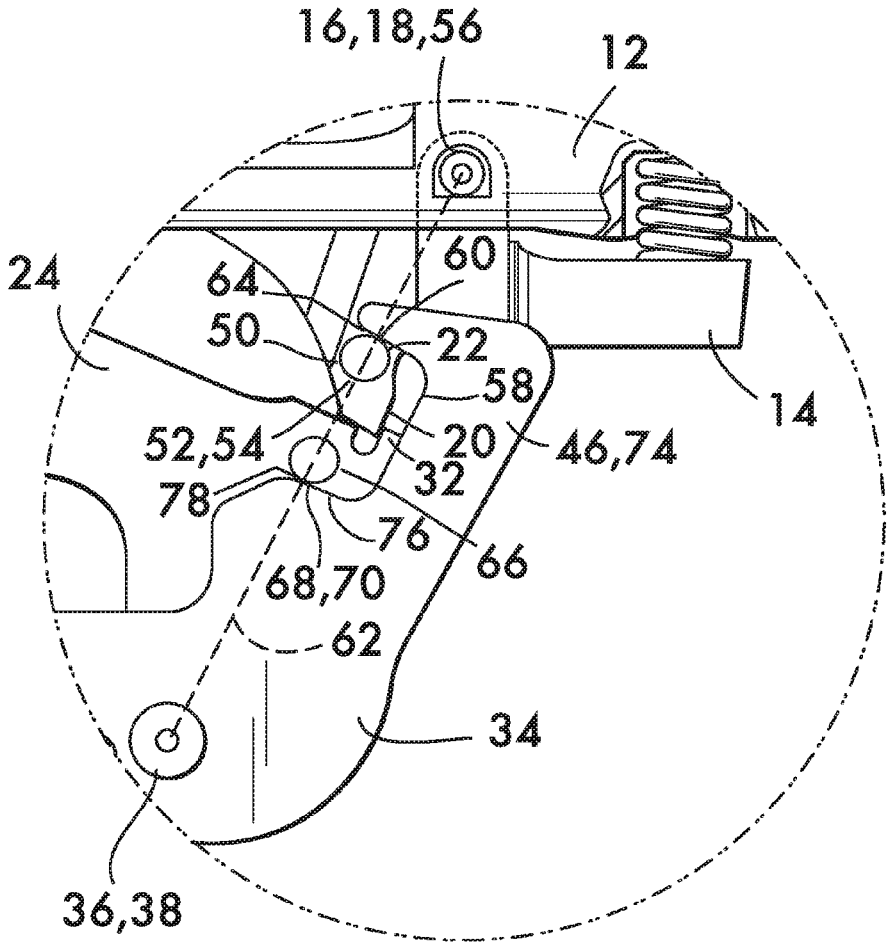
FIG. 1A shows a portion of the example trigger mechanism on an enlarged scale.

Mechanism 10 comprises a sear 14 pivotably mounted on the firearm (represented by receiver 12) for pivoting motion about the sear pivot point 16. In a practical example the sear 14 is mounted on a sear pin 18 and, as shown in FIG. 1A, has an action surface 20 and a sear locking surface 22. A trigger 24 is also pivotably mounted on the firearm 12, the trigger pivoting about a trigger pivot point 26 through which a trigger pin 28 passes. Trigger 24 has a finger engaging portion 30 and, as shown in FIG. 1A, a contact surface 32 which is movable into and out of engagement with the action surface 20 of the sear 14 upon pivoting motion of the trigger 24. Engagement of the sear action surface 20 with the trigger contact surface 32 prevents motion of the sear 14 about its pivot point 16.

A sear block 34 (see FIG. 1) is mounted on trigger 24 for pivoting motion about a sear block pivot point 36, the pivot point defined by a pin 38 passing through the trigger 24 and the sear block 34. In this example embodiment the sear block 34 comprises a finger engaging portion 40 extending through a slot 42 in the finger engaging portion 30 of the trigger 24, permitting simultaneous actuation of both the sear block 34 and the trigger 24. Finger engaging portion 40 of the sear block 34 is positioned on a first side 44 of the sear block pivot point 36 and a sear dog 46 is positioned on a second side 48 of the sear block pivot point 36. As shown in FIG. 1A, sear dog 46 is movable into and out of engagement with the sear locking surface 22 upon pivoting motion of the sear block 34. Engagement between the sear dog 46 and the sear locking surface 22 prevents motion of the trigger 24. In the example embodiment shown the sear locking surface 22 comprises a surface 50 positioned on a projection 52 extending from the sear 14. Projection 52 takes the form of a pin 54 oriented parallel to the pivot axis 56 of the sear 14 in this embodiment.

Further by way of example, the sear dog 46 comprises a notch 58 positioned in the sear block 34. Notch 58 has an edge surface 60 which engages the sear locking surface 22 (the surface 50 on pin 54 in the example shown). Edge surface 60 is advantageously oriented at an angle with respect to a line 62 extending through the sear block pivot point 36 and the sear pivot point 16 when the edge surface 60 engages the sear locking surface 22. This orientation permits the sear dog 46 to disengage from the sear locking surface 22 when the sear block 34 is actuated. It is further advantageous to position the sear locking surface 22 such that the point of contact 64 between the sear dog 46 and the sear locking surface 22 is aligned co-linearly (see line 62) with the sear pivot point 16 and the sear block pivot point 36. The angular orientation of surface 60 with respect to line 62 aids in achieving this alignment. This alignment helps to maintain the sear dog 46 engaged with the sear locking surface 22 when mechanism 10 is subjected to inertial forces and thus helps prevent accidental discharge, for example, when the firearm is dropped. Further advantage is obtained by balancing the sear block 34 about its pivot point 36, which eliminates torque on the sear block which would otherwise be induced by inertial loads.

In the illustrated example embodiment 10 the trigger 24 has a trigger locking surface 66 mounted on the trigger. The trigger locking surface 66 in this example is positioned on a projection 68 extending from the trigger 24. In a practical embodiment the projection 68 comprises a pin 70 oriented parallel to the pivot axis 72 of the trigger 24 (see FIG. 1). A trigger dog 74 is mounted on the sear block 34. The trigger dog 74 is movable into and out of engagement with the trigger locking surface 66 upon pivoting motion of the sear block 34. In this example notch 58 in the sear block 34 comprises the trigger dog 74, the notch having an edge surface 76 engageable with the trigger locking surface 66. Edge surface 76 is advantageously oriented at an angle with respect to a line 62 extending through the sear block pivot point 36 and the sear pivot point 16 when the edge surface 60 engages the sear locking surface 22. This arrangement helps seat the trigger dog 74 with the trigger locking surface 66 upon motion of the sear block 34. It is further advantageous to align the point of contact 78 between the trigger dog 74 and the trigger locking surface 66 co-linearly with the sear pivot point 16 and the sear block pivot point 36 (see line 62). The angular orientation of surface 76 with respect to line 62 aids in achieving this alignment. Use of both the sear dog 46 and the trigger dog 74 engaging respective locking surfaces 22 and 66 on the sear 14 and the trigger 24 renders the dimensional tolerances on the trigger and sear less critical than if the sear dog 46 were used alone to prevent trigger motion.

Figure 2:
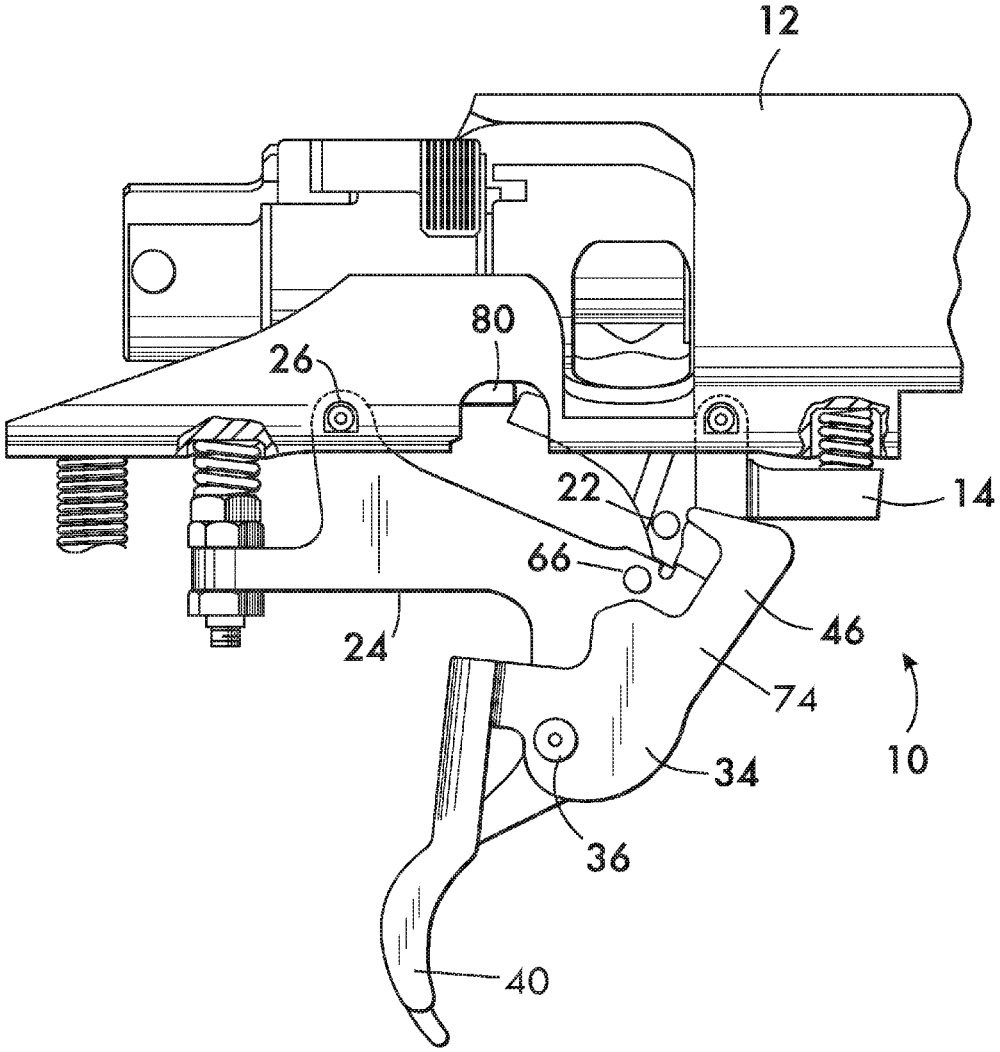
Figure 3:
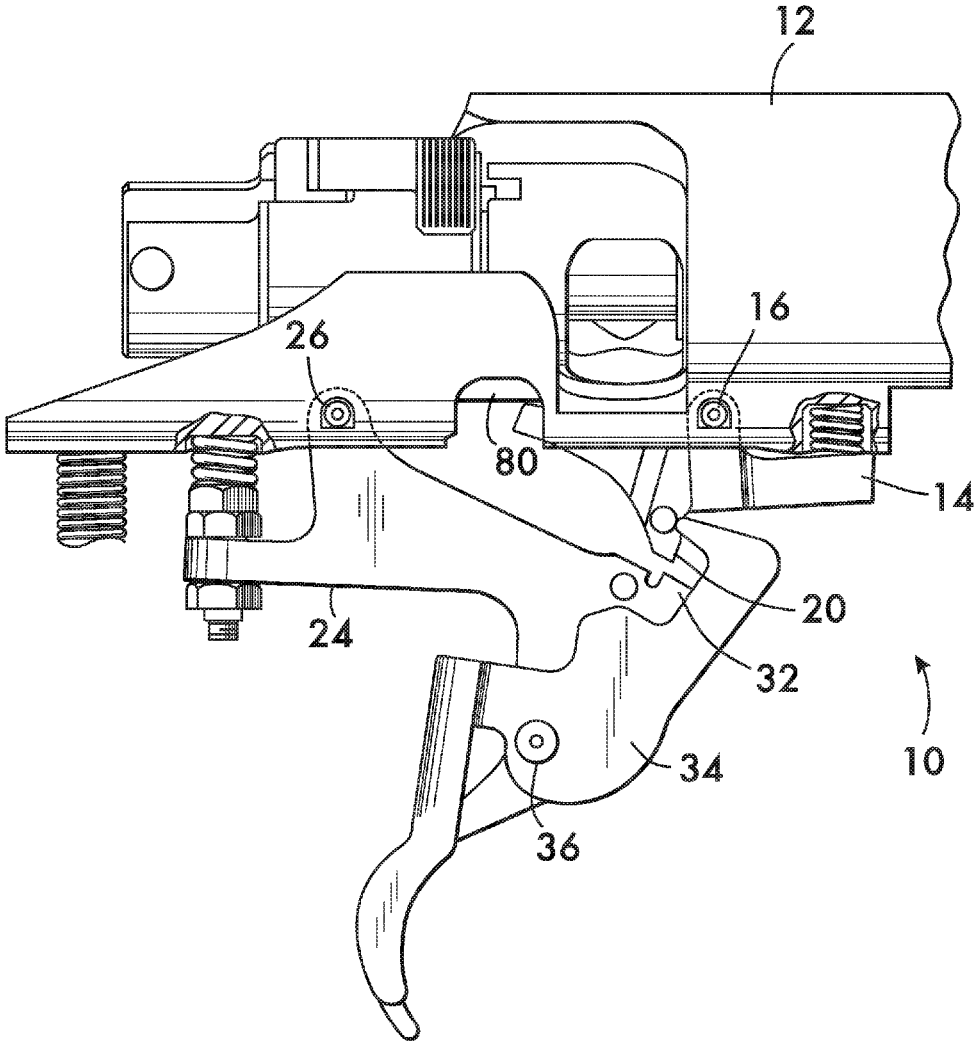

Operation of the mechanism is shown in FIGS. 1, 2 and 3. FIG. 1 shows the mechanism "ready to fire", with the sear 14 holding the firing pin 80 in the cocked position, the trigger contact surface 32 engaging the sear action surface 20 (thereby holding the sear 14 in position), the sear dog 46 engaging the sear locking surface 22, and the trigger dog 74 engaging the trigger locking surface 66 (see also FIG. 1A). As shown in FIG. 2, when force is applied to the finger engaging portion 40 of the sear block 34 the sear block pivots clockwise about its pivot point 36 and disengages the sear dog 46 from the sear locking surface 22 and disengages the trigger dog 74 from the trigger locking surface 66. This pivoting of the sear block 34 permits pivoting of the trigger 24 about its pivot point 26, shown in FIG. 3. Upon clockwise pivoting of the trigger 24 the sear action surface 20 falls off the trigger contact surface 32 (see also FIG. 1A) permitting the sear 14 to pivot counter clockwise and release the firing pin 80.

It is expected that the trigger mechanism according to the invention will effectively decrease the tendency of accidental discharge due to inertial forces applied to the firearm.

What is claimed is:

1. A trigger mechanism for a firearm, said trigger mechanism comprising:

a sear mounted on said firearm for pivoting motion about a sear pivot point, said sear having an action surface and a sear locking surface thereon;

a trigger pivotably mounted on said firearm, said trigger having a contact surface movable into and out of engagement with said action surface of said sear upon pivoting motion of said trigger;

a sear block mounted on said trigger for pivoting motion about a sear block pivot point, said sear block comprising a finger engaging surface positioned on a first side of said sear block pivot point and a sear dog positioned on a second side of said sear block pivot point, said sear dog being movable into and out of engagement with said sear locking surface upon pivoting motion of said sear block, said sear pivot point and said sear block pivot point being aligned co-linearly with a point of contact between said sear dog and said sear locking surface when said sear dog engages said sear locking surface; wherein engagement between said sear dog and said sear locking surface prevents pivoting motion of said trigger.

2. The trigger mechanism according to claim 1, further comprising:

a trigger locking surface mounted on said trigger;

a trigger dog mounted on said sear block, said trigger dog being movable into and out of engagement with said trigger locking surface upon pivoting motion of said sear block.

3. The trigger mechanism according to claim 2, wherein said sear pivot point and said sear block pivot point are aligned co-linearly with a point of contact between said sear dog and said sear locking surface and a point of contact between said trigger locking surface and said trigger dog.

4. The trigger mechanism according to claim 2, wherein said trigger locking surface is positioned on a projection extending from said trigger.

5. The trigger mechanism according to claim 4, wherein said projection comprises a pin oriented parallel to a pivot axis of said trigger.

6. The trigger mechanism according to claim 2, wherein said trigger dog comprises a notch positioned in said sear block, said notch having an edge surface engageable with said trigger locking surface.

7. The trigger mechanism according to claim 6, wherein said edge surface is oriented at an angle with respect to a line extending through said sear block pivot point and said sear pivot point when said edge surface engages said trigger locking surface.

8. The trigger mechanism according to claim 1, wherein said sear locking surface is positioned on a projection extending from said sear.

9. The trigger mechanism according to claim 8, wherein said projection comprises a pin oriented parallel to a pivot axis of said sear.

10. The trigger mechanism according to claim 1, wherein said sear dog comprises a notch positioned in said sear block, said notch having an edge surface engageable with said sear locking surface.

11. The trigger mechanism according to claim 10, wherein said edge surface is oriented at an angle with respect to a line extending through said sear block pivot point and said sear pivot point when said edge surface engages said sear locking surface.

12. The trigger mechanism according to claim 1, wherein said sear block is balanced about said sear block pivot point.

13. A trigger mechanism for a firearm, said trigger mechanism comprising:

a sear mounted on said firearm for pivoting motion about a sear pivot point, said sear having an action surface and a sear locking surface thereon;

a trigger pivotably mounted on said firearm, said trigger having a trigger locking surface and a contact surface thereon, said contact surface movable into and out of engagement with said action surface of said sear upon pivoting motion of said trigger;

a sear block mounted on said trigger for pivoting motion about a sear block pivot point, said sear block comprising a curved finger engaging surface positioned on a first side of said sear block pivot point;

a sear dog positioned on a second side of said sear block pivot point, said sear dog being movable into and out of engagement with said sear locking surface upon pivoting motion of said sear block;

a trigger dog mounted on said sear block, said trigger dog being movable into and out of engagement with said trigger locking surface upon pivoting motion of said sear block, said sear pivot point and said sear block pivot point being aligned co-linearly with a point of contact between said sear dog and said sear locking surface when said sear dog engages said sear locking surface; wherein engagement between said sear dog and said sear locking surface prevents pivoting motion of said trigger.

14. The trigger mechanism according to claim 13, wherein said trigger dog is positioned between said sear dog and said sear block pivot point.

15. The trigger mechanism according to claim 13, wherein said sear pivot point and said sear block pivot point are aligned co-linearly with a point of contact between said sear dog and said sear locking surface and a point of contact between said trigger locking surface and said trigger dog.

16. The trigger mechanism according to claim 13, wherein said sear locking surface is positioned on a projection extending from said sear.

17. The trigger mechanism according to claim 16, wherein said projection comprises a pin oriented parallel to a pivot axis of said sear.

18. The trigger mechanism according to claim 13, wherein said trigger locking surface is positioned on a projection extending from said trigger.

19. The trigger mechanism according to claim 18, wherein said projection comprises a pin oriented parallel to a pivot axis of said trigger.

20. The trigger mechanism according to claim 13, wherein said sear dog comprises a notch positioned in said sear block, said notch having an edge surface engageable with said sear locking surface.

21. The trigger mechanism according to claim 20, wherein said edge surface is oriented at an angle with respect to a line extending through said sear block pivot point and said sear pivot point when said edge surface engages said sear locking surface.

22. The trigger mechanism according to claim 13 , wherein said trigger dog comprises a notch positioned in said sear block, said notch having an edge surface engageable with said trigger locking surface.

23. The trigger mechanism according to claim 22, wherein said edge surface is oriented at an angle with respect to a line extending through said sear block pivot point and said sear pivot point when said edge surface engages said trigger locking surface.

24. The trigger mechanism according to claim 13, wherein said sear block is balanced about said sear block pivot point.

* * * * *